United States Patent [19]

Maruyama et al.

[11] Patent Number: 4,509,905

[45] Date of Patent: Apr. 9, 1985

[54] COMPRESSOR WITH EXTENDED AREA BETWEEN SUCTION PORT AND SUCTION GROOVE

[75] Inventors: Teruo Maruyama, Hirakata; Shinya Yamauchi, Katano, both of Japan

[73] Assignee: Matsushita Electric Industrial Co., Ltd., Osaka, Japan

[21] Appl. No.: 516,606

[22] PCT Filed: Oct. 27, 1982

[86] PCT No.: PCT/JP82/00420

§ 371 Date: Jun. 27, 1983

§ 102(e) Date: Jun. 27, 1983

[87] PCT Pub. No.: WO83/01659

PCT Pub. Date: May 11, 1983

[30] Foreign Application Priority Data

Oct. 28, 1981 [JP] Japan ..... 56-173497

[51] Int. Cl.[3] ..... F04C 18/00

[52] U.S. Cl. ..... 418/75; 418/80; 418/259

[58] Field of Search ..... 418/75, 78, 80, 150, 418/259, 266–270

[56] References Cited

U.S. PATENT DOCUMENTS 4,413,963 11/1983 Maruyama ..... 418/259

FOREIGN PATENT DOCUMENTS 64356 11/1982 European Pat. Off. ..... 418/259
3878 1/1963 Japan .
56-7079 2/1981 Japan .
70986 5/1982 Japan ..... 418/259
57-20851 5/1982 Japan .
WO83/01818 5/1983 PCT Int'l Appl. .

*Primary Examiner*—Leonard E. Smith
*Assistant Examiner*—Jane E. Obee
*Attorney, Agent, or Firm*—Wenderoth, Lind & Ponack

[57] ABSTRACT

A compressor includes a rotor with slidable vanes, a cylinder receiving the rotor and vanes and side plates fixed to opposite sides of the cylinder. A suction stream intercepting section is provided in the suction passage between adjacent vane chambers from the supply of refrigerant. The rotary compressor has no loss of refrigeration cooling ability at low speed operation and refrigeration cooling is restrained only at high speed operation.

5 Claims, 16 Drawing Figures

COMPRESSOR WITH EXTENDED AREA BETWEEN SUCTION PORT AND SUCTION GROOVE

FIELD OF THE INVENTION

The present invention relates to a rotary compressor having a restraining action of refrigerative ability, i.e. an effect of ability control at high speed time, in a compressor in which numbers of rotation varies and comprises a rotor having vanes provided slidably, a cylinder receiving said rotor and vanes, a side plate which is fixed to both sides of said cylinder and closes tightly space in vane chamber formed by said vanes and rotor and cylinder at its side faces, and a suction groove and a suction port formed in said cylinder or side plate.

BACKGROUND OF THE INVENTION

A compressor generally of the sliding vane type comprises, as shown in FIG. 1, a cylinder 51 having an interior cylindrical space, side plates (not shown in FIG. 1) which are fixed to opposite side faces of the cylinder and tightly closing side faces of a vane chamber 52 as the interior space of the cylinder, a rotor 53 which is arranged eccentrically within the cylinder 51, and plural vanes 55 engaged slidably in respective grooves 54 provided on the rotor 53. A suction port 56 is formed on a side plate, and a discharge hole 57 is formed in cylinder 1. Vanes 55 are urged outwardly by centrifugal force upon rotation of the rotor 53, such that the tip end face of each vane slides on the interior wall face, thereby to prevent leakage of gas from the compressor.

In such a sliding vane type rotary compressor a small and simple construction is possible, compared with the reciprocating type of compressor which is complex in construction and has a large number of parts, and thus recently has been employed as a car air conditioner compressor. However, in this rotary type compressor, there are the following problems compared with the reciprocating type compressor.

Namely, in the case of an automobile air conditioner cooler, the driving force of the engine is transmitted to a pulley of a clutch through a belt and drives a rotary shaft of the compressor. Accordingly, when the sliding vane type compressor is used, its refrigerating ability increases in a straight line in proportion to the rotational speed of the engine of the vehicle.

On the other hand, when the reciprocating type compressor is used, the follow-up property of the suction valve becomes poor at the high speed rotation range, and compressed gas cannot be sucked fully into the cylinder. As a result, the refrigerating ability is saturated at the high speed range. That is, in the reciprocating type compressor, a restraining action on the refrigerating ability acts automatically at the high speed traveling range, while in the rotary type compressor there is no such action, and refrigerating efficiency is decreased due to an increase in compression, or an over-cooled state. As a means to avoid this problem with a rotary compressor, it has been proposed to provide a control valve to vary the opening area of a passage communicated with suction port 56 of the rotary compressor, whereby control is achieved by throttling the opening area at the high speed rotation range. However, this solution has the problems that the control valve must be added separately, and the construction thereof is complex and the cost thereof is high.

As another means to avoid over cooling of the rotary compressor at the high speed range, there has been proposed a construction in which the rotational speed is not increased over a certain value by using fluid clutch, planetary gear, etc. However, in the former, energy loss due to frictional heat generated between relative moving faces is large, and in the latter, the dimensions and shape are large by adding a planetary gear mechanism having a large number of parts. Thus, both these solutions are difficult to utilize practically in recent years when simplification and compactness are required increasingly by the trend for energy savings.

SUMMARY OF THE INVENTION

The prevent inventors have investigated in detail the transitional phenomena of pressure in the vane chamber of a rotary compressor in order to solve problems in the refrigeration cycle of vehicle air conditioners. As a result, it has been found that a self-restraining action of the refrigeration capability at high speed rotation operates effectively even in case of a rotary compressor, in a manner similar to the customary reciprocation type, by selecting and combining suitably parameters such as the area of the suction port, the discharging quantity, the number of vanes, etc., and these matters have been proposed previously in Japanese Patent Application No. 1980-134,048.

The present invention relates to improvements in such proposal, and provides that refrigerant flows into a vane chamber at the upstream side from a vane chamber at the downstream side. Especially, in a compressor having a large number of vanes, an increase efficiency at the low speed range has been realized without reducing the control capability by forming a suction stream passage so that inflow of refrigerant into the vane chamber at the upstream side is intercepted or decreased at a time just before finishing of the suction stroke.

DETAILED DESCRIPTION OF THE INVENTION

Figure 1:
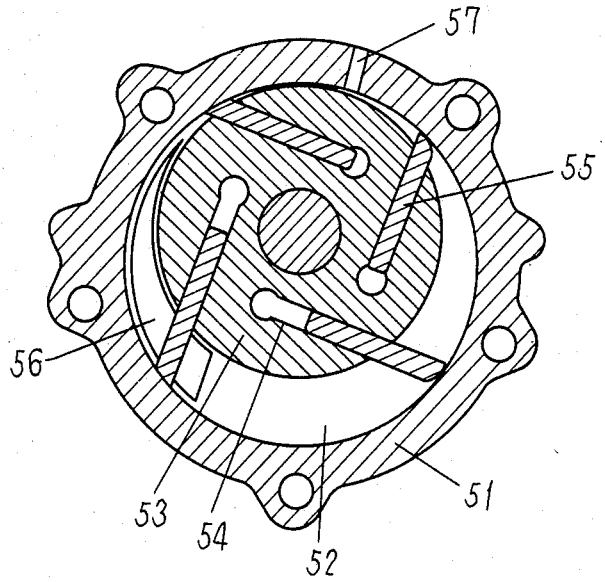
Fig. 1 PRIOR ART
FIG. 1 is a sectional view of customary sliding vane type compressor.
Figure 2:
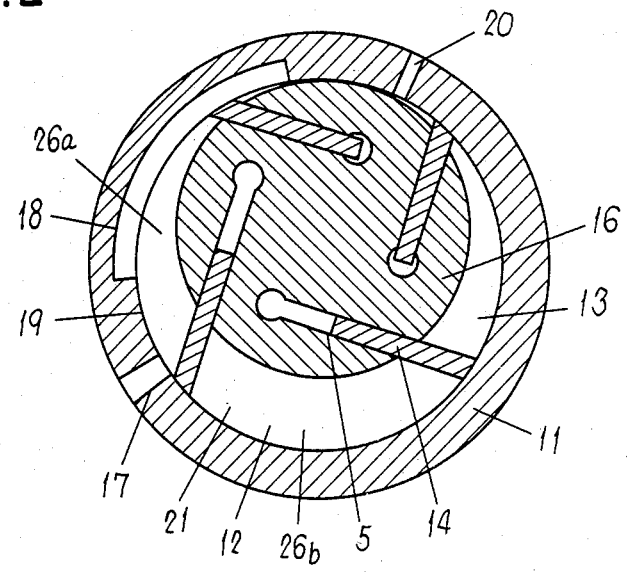
FIG. 2 is a sectional view of four vane type compressor according to an embodiment of the present invention.

A preferred embodiment of the present invention will be explained by FIG. 2 through FIG. 10 as follows. FIG. 2 shows a four vane type compressor including a cylinder 11, a low pressure side vane chamber 12, a high pressure side vane chamber 13, vanes 14, slide grooves 5 for the vanes, a rotor 16, a suction port 17, a suction groove 18, a pressure recovery portion 19 along an intercepting section of a suction stream passage, a discharging hole 20 and a side plate 21.

The traveling angle ($\theta$) of a vane tip end, the pressure recovery beginning angle ($\theta_{s1}$), and the suction finishing angle ($\theta_{s2}$) are defined in the following.

Figure 3:
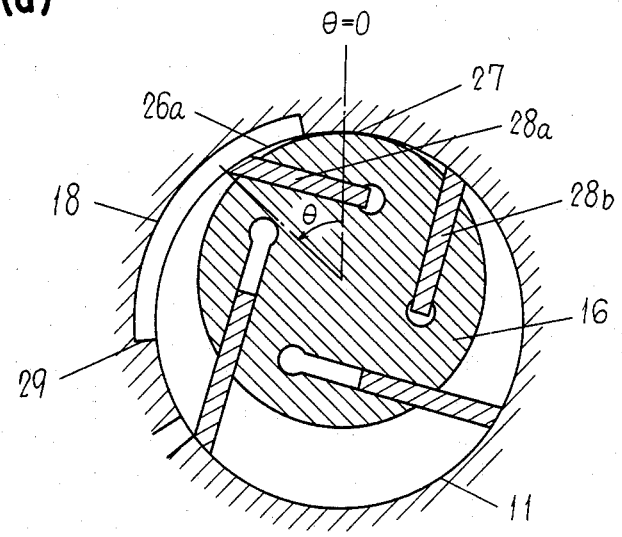
FIGS. 3(*a*)–(*f*) are schematic drawings showing states of inflow of refrigerant into each vane chamber during the suction stroke.
Figure 3:
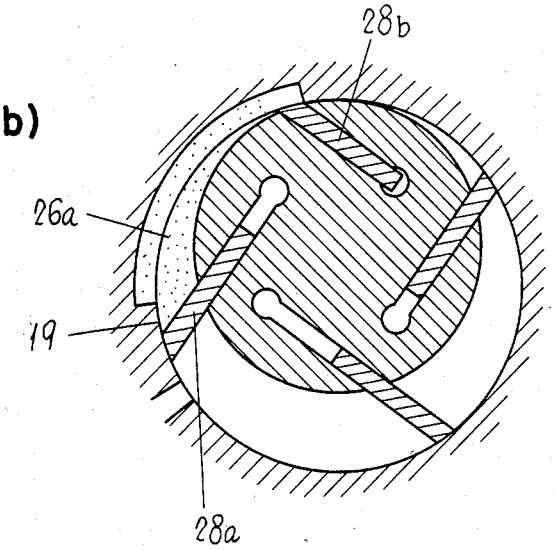
Figure 3C:
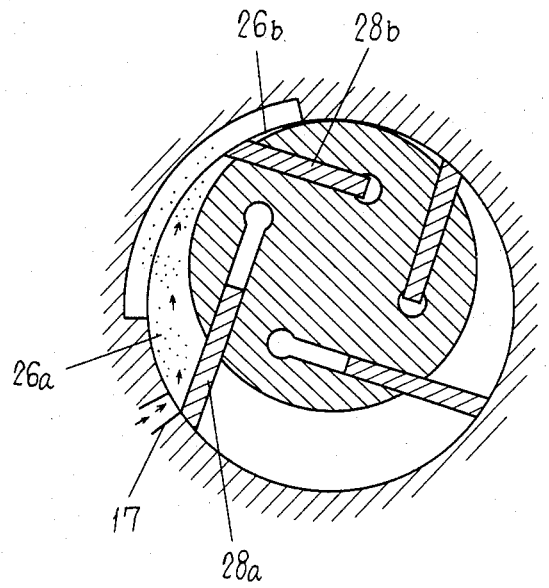
Figure 3:
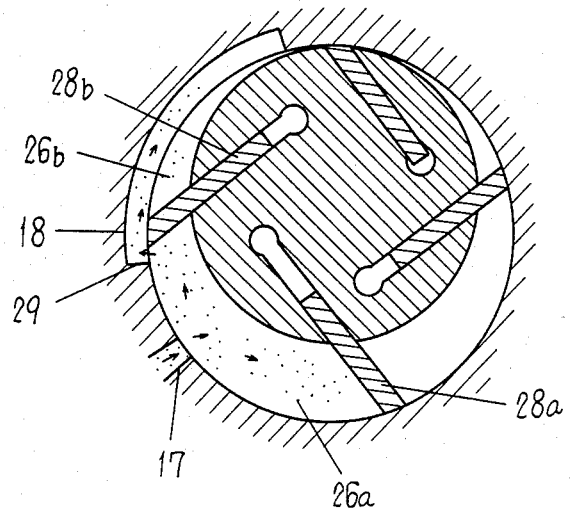
Figure 3:
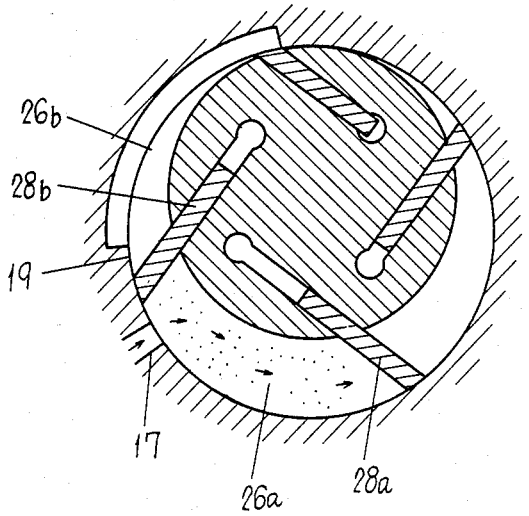
Figure 3F:
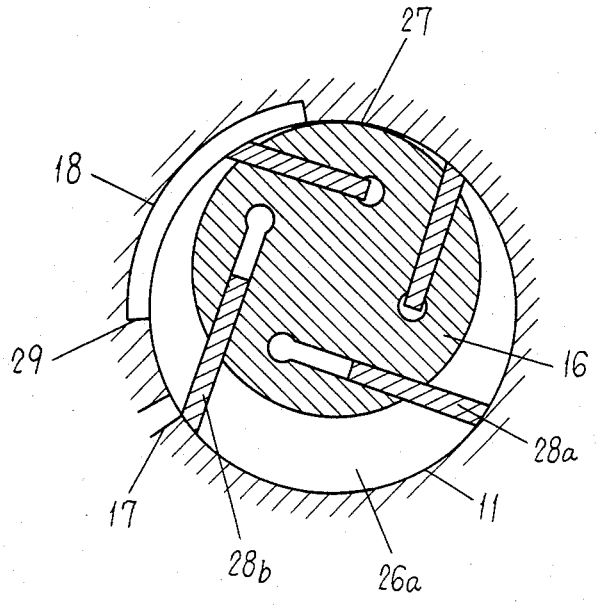

In FIGS. 3(*a*) through (*f*), 26*a* and 26*b* are vane chambers, 27 is a tip part of the cylinder 11, 28*a* and 28*b* are vanes, and 29 is an end part of the suction groove.

The vane chamber 26*a* is an upstream side vane chamber, and the vane chamber 26*b* is a downstream side vane chamber relative to the vane chamber 26*a*.

The rotational center of the rotor 16 is the center of angular measurement, the position where the tip end of a vane passes through the top part 27 of the cylinder is defined as $\theta=0$, i.e. the original angle, and an angle of the tip end of the vane at any position is defined as $\theta$. With reference to the vane chamber 26*a*, FIG. 3(*a*) shows a state where the vane 28*a* has passed through the top part 27 and is traveling along the suction groove 18.

FIG. 3(*b*) shows a state where vane 28*a* is passing through pressure recovery portion 19, and at this time the supply of cooling medium into vane chamber 26*a* is intercepted temporarily.

FIG. 3(*c*) shows a state at a time just after vane 28*a* has passed through the suction port 17, and at this time the suction of refrigerant into the vane chamber 26*a* is recovered again.

FIG. 3(*d*) shows a state where the tip end of the vane 28*b* following to the vane 28*a* almost has reached end part 29 of the suction groove 18. At this time, refrigerant flows into the vane chamber 26*a* in an upstream direction from the suction port 17 and also is supplied into the vane chamber 26*b* in a downstream direction passing through the suction groove 18 as shown by arrow S in the drawing.

FIG. 3(*e*) shows a state where the vane 28*b* is traveling along the pressure recovery portion 19. At this time, since the supply of refrigerant into the vane chamber 26*b* is intercepted, refrigerant is supplied only into the vane chamber at upstream side from the suction port 17, i.e. into chamber 26*a*. Here, the traveling angle $\theta=\theta_{s1}$ of the vane 28*a*, when the vane 28*b* begins movement along the pressure recovery portion 19, is defined as the "pressure recovery beginning angle".

FIG. 3(*f*) shows a state just after the vane 28*b* has passed the suction port 17, and at this time the traveling angle of the vane 26*a* is $\theta=\theta_{s2}$, the volume of the vane chamber 26*a* becomes maximum, and the suction stroke of chamber 26*a* has finished.

The compressor in this embodiment is constructed according to the following parameters.

TABLE 1

| Parameter | Designation | Practical Example |
|---|---|---|
| numbers of vane | n | 4 |
| suction port 17 | $a_1$ | 0.5 $cm^2$ |
| effective area suction groove 18 | $a_2$ | 1.0 $cm^2$ |
| theoretical discharging quantity | Vth | 108 CC |
| rotational angle of tip end of vane at finish of suction | $\theta_{s1}$ | (degree) 225° |
| pressure recovery beginning angle | $\theta_{s2}$ | 210° |
| cylinder width | b | 40 mm |
| cylinder inside radius | Rc | 35 $mm^R$ |
| rotor radius | Rr | 26 $mm^R$ |

In the present embodiment, a compressor having the following features could be realized by the above parameters, namely:

(i) At low speed rotation, reduction of refrigeration ability due to suction loss was small.

This rotary type compressor is not inferior to the reciprocating type compressor with regard to the feature that suction loss is small at low speed rotation due to the self-restraining action on refrigeration ability.

(ii) At high speed rotation, the restraining effect on the refrigeration ability was greater than with the customary reciprocating type compressor.

(iii) Since the restraining effect is possible at rotation speeds up to 1800–2000 rpm or more, by using this compressor as the compressor for a vehicle air conditioner, a refrigeration cycle of ideal energy-saving and good feeling is possible.

The above results (i)–(iii) can be said to be ideal for a vehicle air conditioner refrigeration cycle, and a remarkable feature of the present invention is that these results can be attained without adding any new components to the customary rotary compressor.

Thus, a compressor with refrigeration control can be achieved without losing any of the normal advantages of a rotary type compressor, such as small size, light weight and simple construction. Further, in the case of polytropic change at the suction stroke of the compressor, the total weight of refrigerant in the vane chamber is smaller and the compressing work is smaller as the suction pressure is lower and the specific weight is smaller. Accordingly, in this compressor, in which a reduction of the total weight of refrigerant is achieved automatically at a time before the compression stroke at increased rotation speeds, a reduction of the torque is achieved naturally at high speed rotation ranges.

To prevent over-cooling, one control method, wherein a control valve is connected with the high pressure side and low pressure side of the compressor and the high pressure side refrigerant is returned to the low pressure side valve by causing this valve to open at any time, has been practiced hitherto for the refrigeration cycle of a room service air conditioner, for example. However, in this method, there is the problem that there occurs a compression loss equivalent to the returning quantity of refrigerant which expands again at the low pressure side, thus resulting in a reduction in efficiency.

In the compressor of the present invention, cooling ability control can be performed without preforming useless mechanical work causing compression loss, and a refrigeration cycle which is energy saving and of high efficiency can be realized. Further, the present invention has the feature that the transitional phenomenon of the vane chamber pressure is utilized effectively by a proper combination of each parameter of the compressor, and has no operating part such as a control valve, as described in the following. Therefore, the compressor of the invention has high reliability.

Further, since the cooling ability changes continuously, there is no unnatural cooling character due to discontinuous change-over, as is the case when using a valve, and cooling control resulting in a pleasant and good feeling can be realized.

Such result already has been achieved by the invention of Japanese Patent Application No. 1980-134,048. However, the present invention makes it possible to control cooling ability more effectively in a sliding vane type compressor having large numbers of vanes, e.g., of the three-vane type or four-vane type.

In the following is an analysis explaining the importance of the transitional phenomenon of the pressure of the cooling medium. With regard to a particular vane chamber (e.g., vane chamber 26*a*), the transitional character of the vane chamber pressure when the pressure of the supply source (Ps) is assumed to be constant always can be described by the following energy equation.

$$\frac{Cp}{A} GT_A - Pa\frac{dVa}{dt} + \frac{dQ}{dt} = \frac{d}{dt}\left(\frac{Cv}{A}\gamma aVaTa\right) \quad (1)$$

where, G: quantity (by weight) of flow of refrigerant, Va: volume of the vane chamber, A: heat equivalent of work, Cp: specific heat at constant pressure, $T_A$: refrigerant temperature at the supply side, Cv: specific heat at constant volume, Pa: vane chamber pressure, Q: calorie, $\gamma$a: specific weight of the refrigerant in the vane chamber, Ta: temperature of the refrigerant in the vane chamber. Further, at the following equations (2)–(4), a: suction effective area, g: gravitational acceleration, $\gamma_A$: specific weight of the refrigerant at the supply side, Ps: pressure of the refrigerant at the supply side, k: specific heat ratio, R: gas constant.

In equation (1), the first term on the left side shows heat energy of the refrigerant to be brought into the vane chamber during the unit time the refrigerant passes through the suction port, the second term shows the work to be done by the pressure of the refrigerant against the exterior during this unit time, and the third term shows heat energy flowing into the vane chamber from the exterior through the outer wall during this unit time, and the right side shows the increase of interior energy within the system during this unit time. Assuming that the refrigerant complies with law of ideal gas and that the suction stroke of the compressor is adiabatic since it is rapid, equation (1) may be expressed by the following formula from relation of $\gamma a = Pa/RTa$, $(dQ/dt)=0$.

$$G = \frac{dVa}{dt}\left(\frac{A}{CpTA} + \frac{1}{kRT_A}\right) Pa + \frac{Va}{kRT_A}\cdot\frac{dPa}{dt} \quad (2)$$

And, using relation of $1/R=(A/Cp)+(1/kR)$, $$G = \frac{1}{RT_A}\cdot\frac{dVa}{dt}\cdot Pa + \frac{Va}{kRT_A}\cdot\frac{dPa}{dt} \quad (3)$$

On the other hand, since the theory of nozzles can be applied to the quantity (by weight) of flow of refrigerant which passes through the suction port, $$G = a\sqrt{2g\gamma_A Ps\frac{k}{k-1}\left[\left(\frac{Pa}{Ps}\right)^{\frac{2}{k}} - \left(\frac{Pa}{Ps}\right)^{\frac{k+1}{k}}\right]} \quad (4)$$

Accordingly, by solving formulas (3) and (4) as simultaneous equations, the transitional character of the vane chamber pressure (Pa) can be obtained. But, the volume of the vane chamber $Va(\theta)$ is obtained by following formula, with $m=Rr/Rc$, $$V(\theta) = \frac{bRc^2}{2}\left\{(1-m^2)\theta + \frac{(1-m)^2}{2}\sin 2\theta - (1-m)\sin^{-1}\theta\, 1-(1-m)^2\sin^2\theta - \sin^{-1}[(1-m)\sin\theta]\right\} + \Delta V(\theta) \text{ when } 0<\theta<\frac{\pi}{2},\ Va(\theta) = V(\theta) \text{ when } \frac{\pi}{2}<\theta<\theta s,\ Va(\theta) = V(\theta) - V\left(\theta - \frac{\pi}{2}\right) \quad (5)$$

In formula (5) $\Delta V(\theta)$ is a correction term because the vane is arranged eccentrically from the center of the rotor, but this value is usually on the order of 1–2%. The case of $\Delta V(\theta)=0$ is shown in FIG. 4(*a*).

Figure 4:
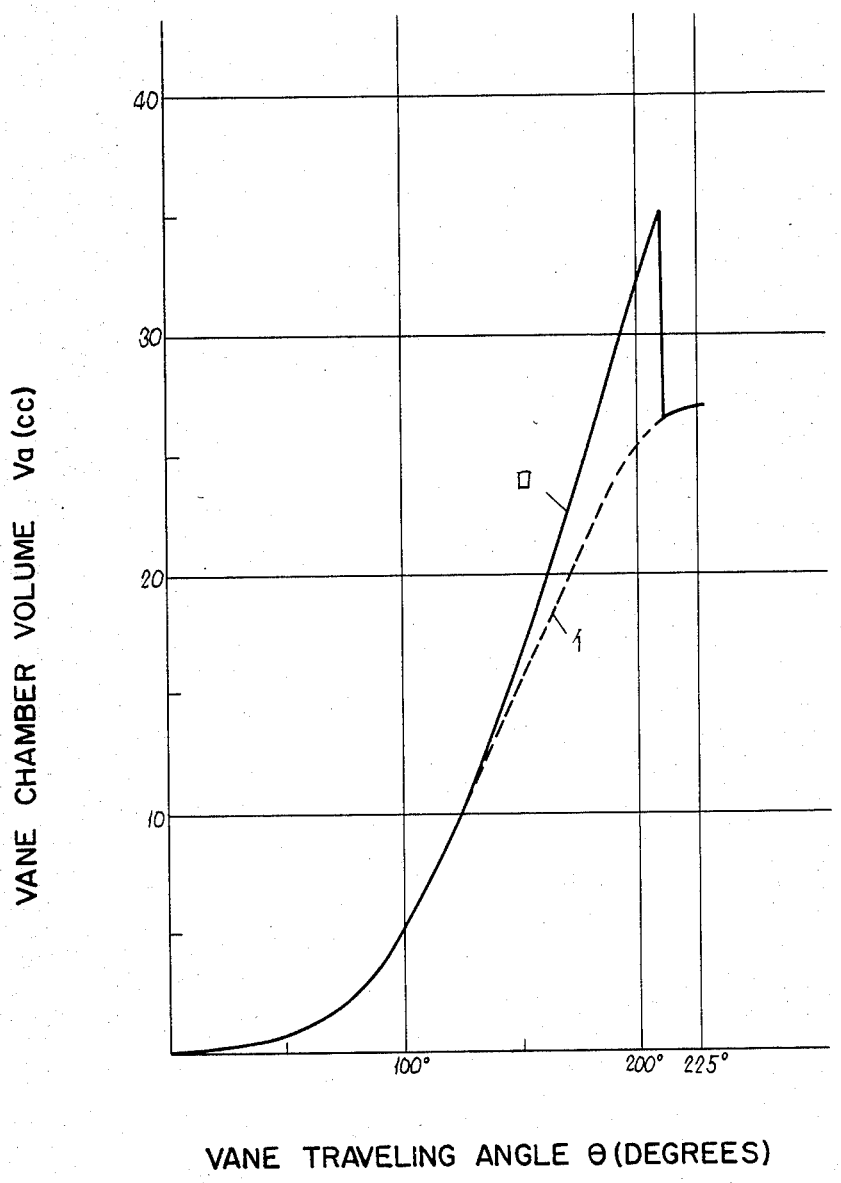
FIG. 4 is a graph showing the relationship of vane chamber volume (Va) relative to vane travel angle ($\theta$).

FIG. 4(*b*) shows the practical volume of the vane chamber seen from the suction port 17 in the compressor of FIG. 2 showing one embodiment of the present invention. Namely, as shown in FIG. 3(*d*), since refrigerant flows into both the upstream side vane chamber 26*a* and downstream side vane chamber 26*b*, the volume of refrigerant in the downstream side vane chamber 26*b* with lagged phase difference $\Delta\theta=90°$ is added to the volume Va. The curve (b) of FIG. 4 changes rapidly to the curve (a) at angle $\theta=\theta_{s1}=210°$, due to the fact that the supply of refrigerant into the vane chamber 26*b* is intercepted due to the traveling of the vane 28*b* along the pressure recovery portion 19.

Figure 5:
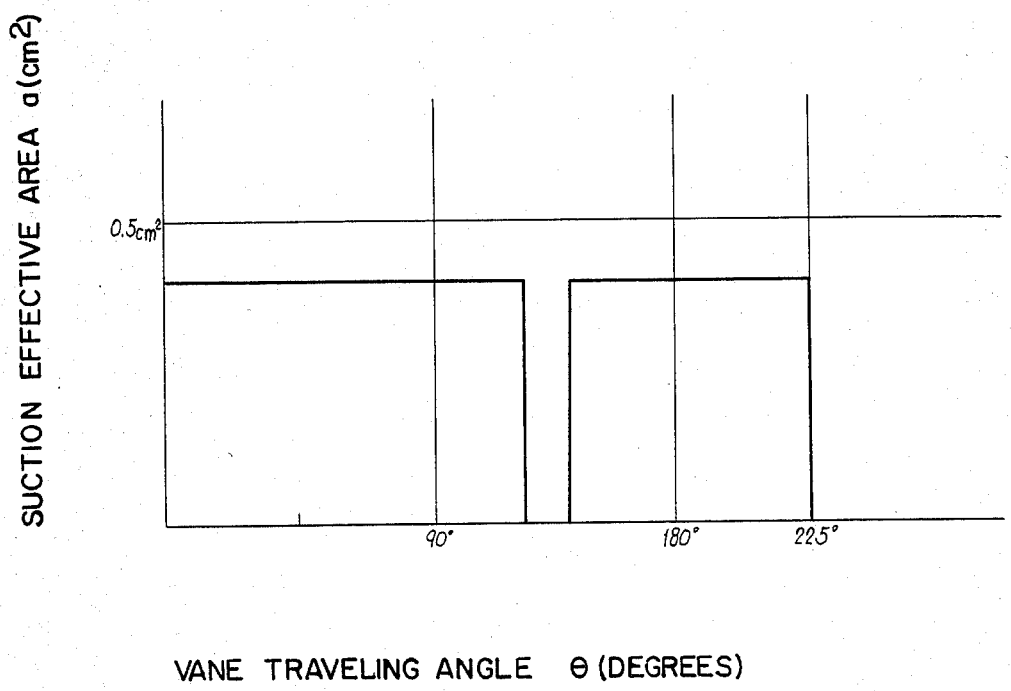
FIG. 5 is a graph showing the relationship of suction effective area (a) relative to vane travel angle ($\theta$).

FIG. 5 shows the suction effective area between one vane chamber and the supply source of refrigerant at the suction stroke. The effective area becomes zero, i.e. $a=a_1=0$ in the section of $120°<\theta<135°$, also due to the fact that the supply of refrigerant from the upstream side vane chamber is intercepted at this section by vane 28*b*. (FIG. 3(*a*)). Further, the effective area (a) is determined only by $a_1$ due to the fact that the suction groove 18 and suction port 17 have been formed so that $a_1<a_2$ always in this embodiment.

Figure 6:
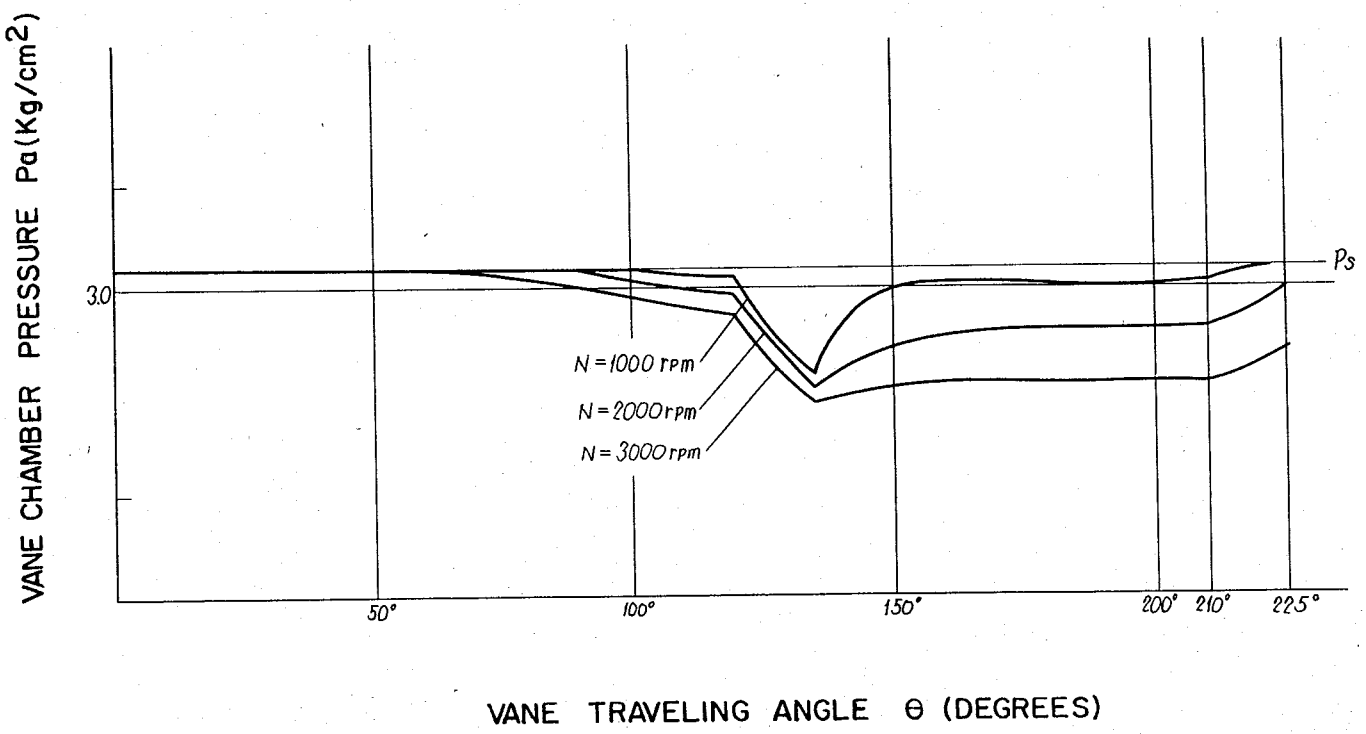
FIG. 6 is a graph showing the relationship of vane chamber pressure (Pa) relative to vane travel angle ($\theta$).

FIG. 6 is a diagram in which the transitional character of the vane chamber pressure is obtained for various rotation speeds under the early condition of $t=0$, $p-Ps$ using formula (3) and (4), volume Va curve (b) in FIG. 4, suction effective area (a) in FIG. 5, and the conditions in Tables 1 and 2. Since R12 is used usually as refrigerant for a vehicle air conditioner refrigeration cycle, the analysis was performed as to values of $k=1.13$, $R=668$ Kg·cm/°K.·Kg, $\gamma A=16.8\times10^{-6}$ Kg/cm$^3$, $T_A=283°$ K.

TABLE 2

| Parameter | Designation | Practical Example |
|---|---|---|
| supply side pressure of refrigerant | Ps | 3.18 Kg/cm$^2$ abs |
| supply side temperature of refrigerant | $T_A$ | 283° K. |
| discharge side pressure of refrigerant | Pd | 15.51 Kg/cm$^2$ abs |
| number of rotations | N | 600–5000 rpm |

Further, the vane chamber pressure begins rising from the time just before finishing of the suction stroke (i.e., $\theta=210°$), and this is due to the fact that a rapid decrease in the vane chamber volume is achieved by interception of the supply of refrigerant into the downstream side vane chamber 26b, as shown in FIG. 4. In this embodiment, each parameter of the compressor was determined so that the vane chamber pressure (Pa) could attain the supply pressure (Ps) at the time just before finishing of the suction stroke in the case of N=1000 rpm.

Figure 7:
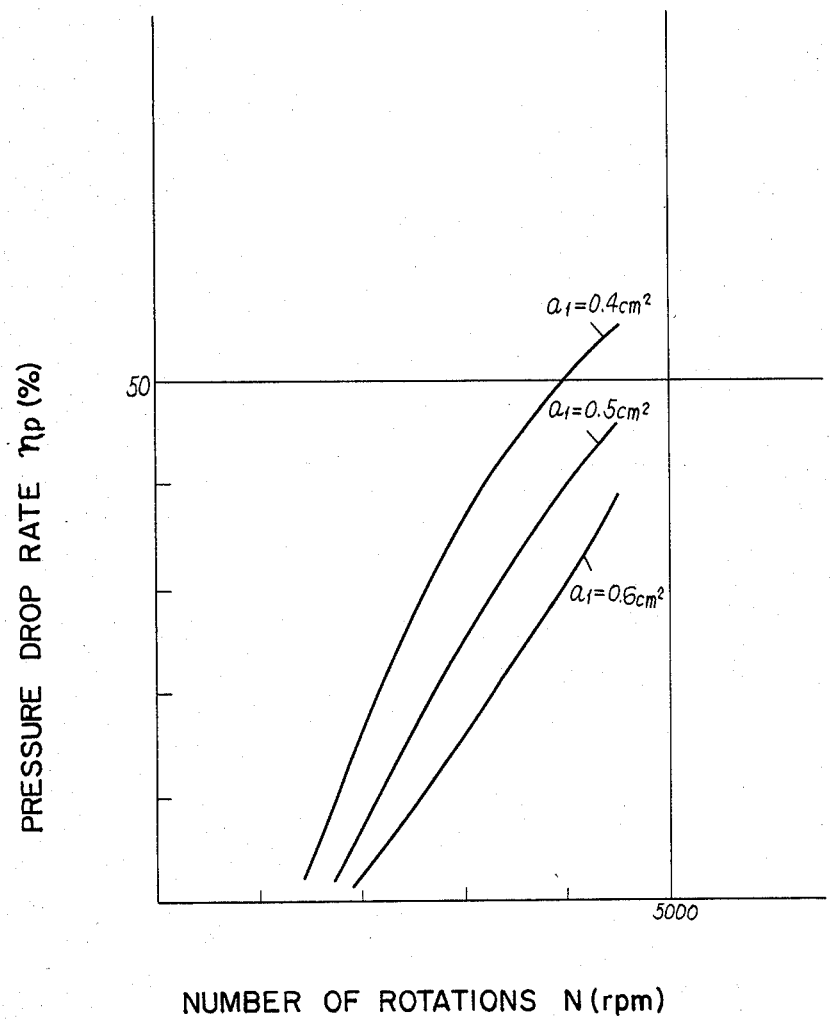
FIG. 7 is a graph showing the relationship of rate of pressure drop ($\eta_p$) relative to the rotational speed (N) of the rotor.

FIG. 7 is a diagram in which the rate of pressure drop relative to number of rotations was obtained using parameters of the effective area ($a_1$) of the suction stream passage. But, pressure drop rate ($\eta_p$) when the vane chamber pressure at time of finish of the suction stroke is Pa=Pas is defined as follows, $$\eta_p = \left(1 - \frac{Pas}{Ps}\right) \times 100 \qquad (6)$$

The result shown in FIG. 7 is not inferior compared with a compressor of the two vane type of the invention of Japanese Patent Application No. 1980-134,048. Thus, it is seen that the present invention is extremely useful when cooling ability control is performed in a compressor with a larger number of vanes.

Figure 8:
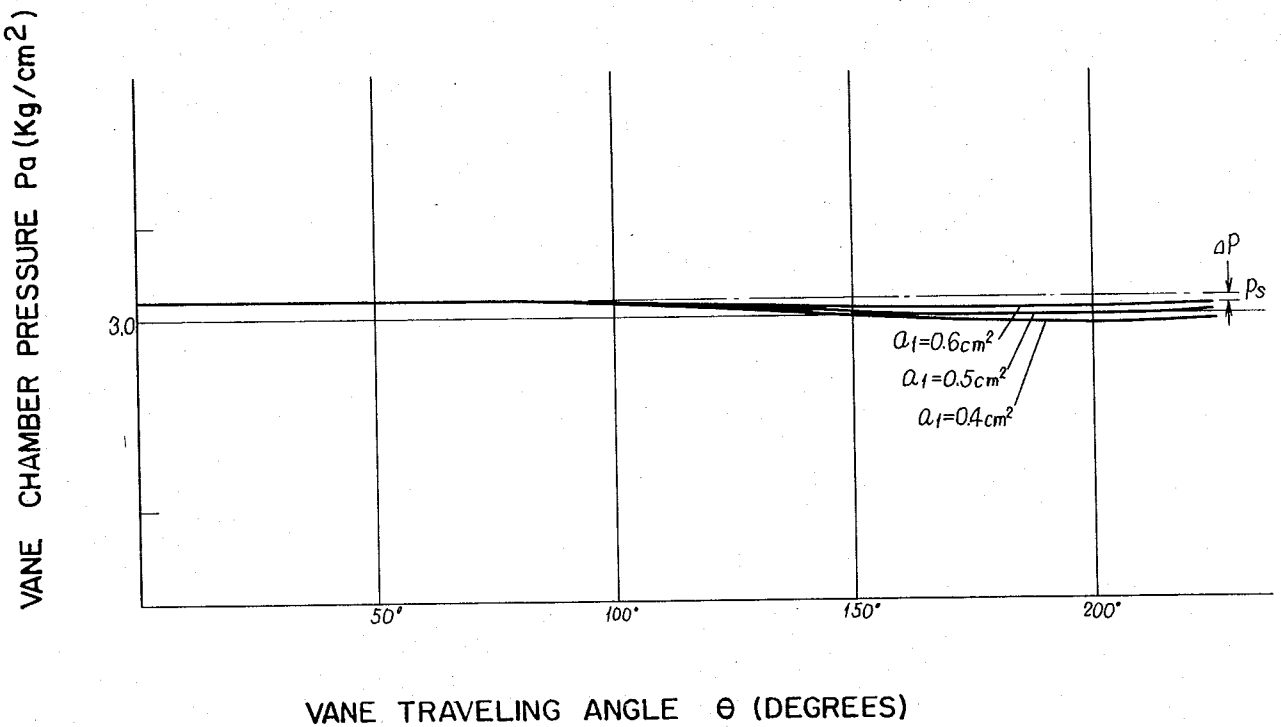
FIG. 8 is a graph showing the relationship of vane chamber pressure (Pa) relative to vane travel angle ($\theta$).

As a reference, FIG. 8 shows a transitional character of the vane chamber pressure at N=1000 rpm when a pressure recovery portion is not provided. In this figure it is seen that, even if the suction effective area is increased to, e.g., $a_1-0.6$ cm$^2$, a pressure loss ($\Delta p$) still exists at the time just before finishing of the suction stroke and that a drop in volume efficiency occurs.

Figure 9:
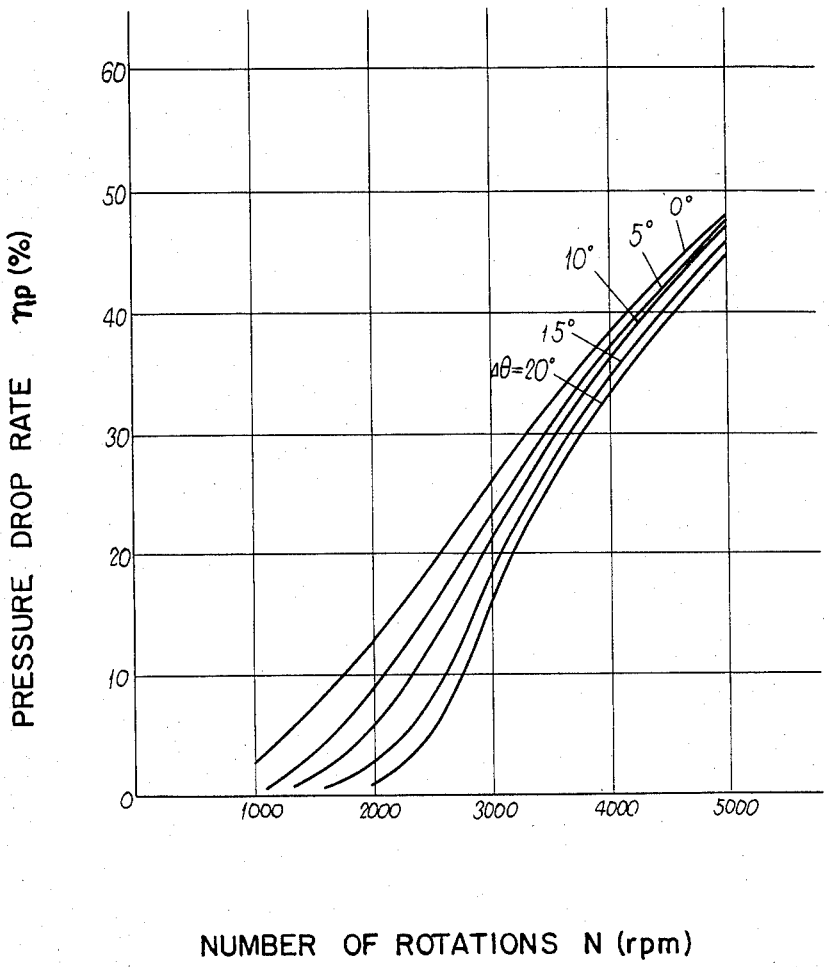
FIG. 9 is a graph showing the relationship of N to $\eta_p$ for different parameters of $\Delta\theta$.

FIG. 9 is a diagram showing the pressure drop rate relative to the number of rotations obtained with different parameters of intercepting section ($\Delta\theta$) of the suction groove. As $\Delta\theta$ becomes smaller, the pressure drop rate ($\eta_p$) becomes larger and a drop in volume efficiency occurs. But, the different of $\eta_p$ at times of high speed rotation due to the difference of $\Delta\theta$ is not as large as at low speed rotation, and by properly forming the intercepting section of the suction groove, it is possible to provide a cooling ability control which has no loss at low speed and refrigerant cooling ability being restrained effectively only at high speed rotation.

In the practical example, a full intercepting section has been provided at pressure recovery portion 19. However, the objects of the present invention can be attained by forming sufficiently shallow grooves along pressure recovery portion 19.

Figure 10:
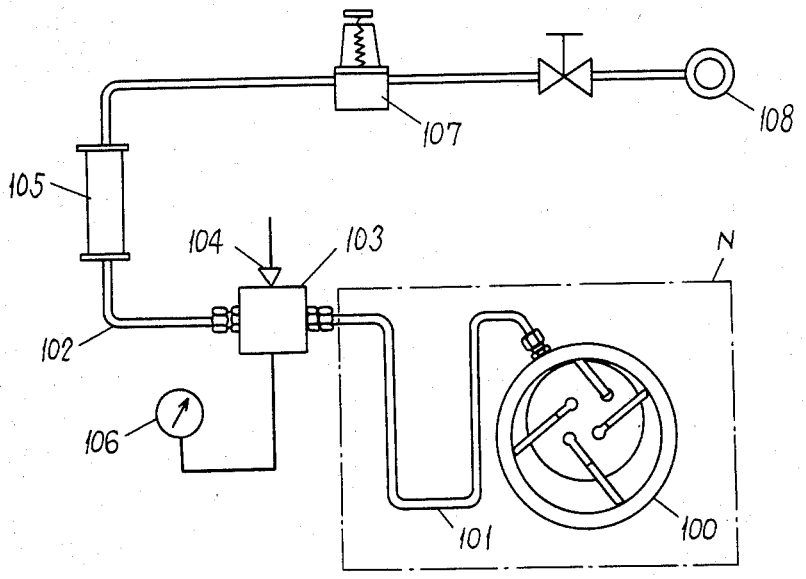
FIG. 10 is a schematic view illustrating a practical method of measuring suction effective area.

Now, "suction effective area" in the present invention means a value as follows. A rough value of this suction effective area (a) can be obtained from a value of minimum sectional area among the fluid course from the outlet of the evaporator to the vane chamber of the compressor multiplied by a flow-contracting factor (C=0.7–0.9). But, strictly speaking, suction effective area (a) is defined as a value to be obtained from experimentation in accordance with a method used in JISB8320, etc. FIG. 10 shows one example of such experimental method, and wherein 100 is a compressor, 101 is a pipe to connect an evaporator with a suction port of the compressor, as the compressor is equipped on a vehicle, 102 is a pipe for supply of high pressure air, 103 is a housing to connect the pipes 101 and 102, 104 is a thermocouple, 105 is a flow meter, 106 is a pressure gauge, 107 is a pressure regulating valve, and 108 is a high pressure air source.

The portion enclosed by the dotted chain line (N) in FIG. 10 corresponds to the compressor of the present invention. However, in the experimental device, if the throttled part which cannot be ignored as fluid resistance exists within the evaporator, it is necessary to add an equivalent throttle to the pipe 101.

Indicating the pressure of the high pressure air source: $P_1$ Kg/cm$^2$ abs., atmospheric pressure: $P_2=1.03$ Kg/cm$^2$ abs., specific heat ratio: $k_1=1.4$, specific weight: $\gamma 1$, gravitational acceleration: $g=980$ cm/sec$^2$, and when the weight of the flow quantity to be gained under such condition is indicated by $G_1$, suction effective area (a) is obtained from following formula:

$$a = G_1\sqrt{2g\gamma_1 P_1 \frac{k_1}{k_1-1}\left\{\left(\frac{P_2}{P_1}\right)^{\frac{2}{k1}} - \left(\frac{P_2}{P_1}\right)^{\frac{k1+1}{k1}}\right\}} \qquad (7)$$

But the pressure of high pressure air source ($P_1$) is set so as to be within the range of $0.52B<P_1<P_2<0.9$.

Figure 11:
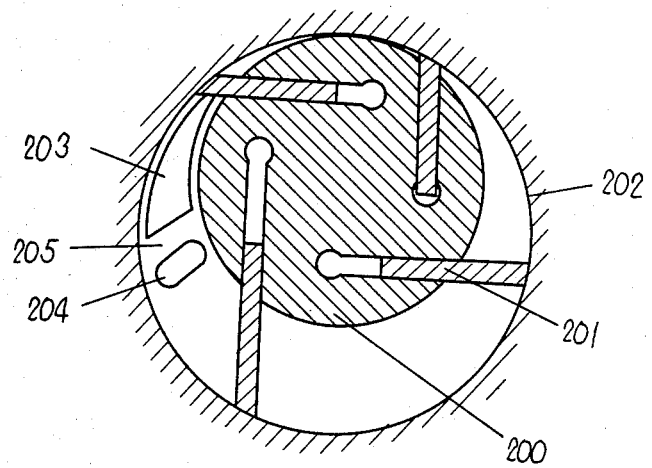
FIG. 11 is a front sectional view of compressor showing another embodiment of the present invention.

FIG. 11 shows another embodiment of the present invention, and wherein a compressor includes a rotor 200, vanes 201, a cylinder 202, a suction groove 203 formed in a side plate, a suction port 204 formed also in the side plate, and a pressure recovery portion 205.

In the embodiment of FIG. 2, both the suction groove and the suction port are formed in the cylinder, though those may be formed in a side plate as shown in FIG. 11.

In the above-mentioned example, there is described a practical example in which the present invention is applied to a sliding vane compressor of the four vane type, but the present invention can be used regardless of the discharging quantity of the compressor and the number and type of vanes. The discharging quantity can be increased by positioning the vanes eccentrically of the center of rotor. Of course, the invention may be employed without eccentric vanes.

Also, the compressor may have unevenly arranged vanes instead of the illustrated arrangement wherein the vanes arranged with equal angles between adjacent vanes.

Further, although the true-circular type cylinder is used in the present practical example, the cylinder may be of the elliptic type.

INDUSTRIAL APPLICABILITY

As described above, when the compressor is constructed according to the present invention, the loss of refrigeration ability is small at low speeds, and the refrigeration ability is restrained effectively only at high speeds, whereby it is possible to control cooling with a simple structure without any additions to a conventional rotary compressor. Thus, in the present invention, since an increase in volume efficiency at low speed rotation can be achieved, the invention can be applied also to a compressor where ability control is unnecessary, e.g., a constant type compressor, and the effect is remarkable.

What is claimed is:

1. In a rotary compressor of the type including a cylinder, a rotor mounted eccentrically within the interior of said cylinder for rotation, a plurality of vanes mounted on said rotor for rotation therewith, said vanes having ends contacting said cylinder and dividing the interior thereof into vane chambers which progressively increase and then decrease in volume during rotation, and side plates fixed to opposite sides of said cylinder and closing the interior thereof, the improvement comprising:

suction port means for introducing refrigerant into a first said vane chamber during a suction stroke of said first vane chamber;

suction groove means for permitting refrigerant from said suction port means to pass from said first vane chamber to a second said vane chamber located immediately upstream of said first vane chamber with respect to the direction of rotation of said rotor during a first portion of said suction stroke of said first vane chamber; and means positioned to be contacted by the said vane between said first and second vane chambers during a second portion of said suction stroke of said first vane chamber just prior to completion thereof, and thereby for restricting the passage of said refrigerant from said first vane chamber to said second vane chamber.

2. The improvement claimed in claim 1, wherein said suction port means and said suction groove means respectively comprise a port and a groove formed in the inner surface of said cylinder.

3. The improvement claimed in claim 2, wherein said restricting means comprises a portion of said inner surface of said cylinder located between said port and said groove and contacted by the end of said vane, thereby interrupting said refrigerant passage.

4. The improvement claimed in claim 1, wherein said suction port means and said suction groove means respectively comprise a port and a groove formed in one said side plate.

5. The improvement claimed in claim 4, wherein said restricting means comprises a portion of said one side plate located between said port and said groove and contacted by said vane, thereby interrupting said refrigerant passage.

* * * * *